US006701825B1

(12) United States Patent
Langenfeld

(10) Patent No.: US 6,701,825 B1
(45) Date of Patent: Mar. 9, 2004

(54) RETURN TO NEUTRAL DEVICE FOR A HYDRAULIC APPARATUS

(75) Inventor: Thomas J. Langenfeld, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 61 days.

(21) Appl. No.: 10/144,280

(22) Filed: May 10, 2002

Related U.S. Application Data

(60) Provisional application No. 60/290,838, filed on May 14, 2001.

(51) Int. Cl.[7] ..... F01B 3/02

(52) U.S. Cl. ..... 92/12.2; 60/487

(58) Field of Search ..... 91/505; 92/12.2; 60/487

(56) References Cited

U.S. PATENT DOCUMENTS

| | | | | | |
|---|---|---|---|---|---|
| 4,283,962 | A | * | 8/1981 | Forster | 91/505 |
| 4,845,949 | A | * | 7/1989 | Shivvers et al. | 92/12.2 |
| 5,207,144 | A | | 5/1993 | Sporrer et al. | |
| 5,241,872 | A | * | 9/1993 | Betz et al. | 92/12.2 |
| 5,314,387 | A | | 5/1994 | Hauser et al. | |
| 5,836,159 | A | | 11/1998 | Shimizu et al. | |
| 6,253,637 | B1 | | 7/2001 | Hauser et al. | |

* cited by examiner

*Primary Examiner*—F. Daniel Lopez
(74) *Attorney, Agent, or Firm*—Neal, Gerber & Eisenberg, LLP

(57) ABSTRACT

In a hydrostatic device using an axial piston pump, a return plate is mounted so that it contacts the movable swash plate of the hydrostatic transmission. The plate is biased by a spring-type mechanism to force the swash plate to return to neutral, and the set position of the plate may be externally adjusted to compensate for irregularities. A second plate may be used where necessary based on the arrangement of the return plate with respect to the pump cylinder block.

62 Claims, 13 Drawing Sheets

RETURN TO NEUTRAL DEVICE FOR A HYDRAULIC APPARATUS

CROSS-REFERENCE TO RELATED APPLICATION

This application claims the benefit of U.S. Provisional Patent Application Serial No. 60/290,838 filed on May 14, 2001, which is incorporated herein by reference in its entirety.

BACKGROUND

This invention relates to an improved design of a variable displacement hydraulic unit such as a pump or hydrostatic transmission ("HST"), and in particular to an improved return to neutral feature. Hydrostatic transmissions and other hydraulic units using an axial piston design are well known in the art. While this invention will be generally described in connection with an HST, it is understood that this invention could be applied to a variety of hydrostatic units, such as stand-alone pumps using external hoses. The invention described herein can also be adapted for use in an integrated hydrostatic transmission ("IHT") incorporating output gearing and axles, and a wide variety of uses, including vehicles and industrial applications.

In general, an HST has a hydraulic pump and a hydraulic motor mounted in a housing. The pump and motor are hydraulically linked through a generally closed circuit, and both consist of a rotatable body with pistons mounted therein. Hydraulic fluid such as oil is maintained in the closed circuit, and the HST generally has a sump or reservoir with which the closed circuit can exchange oil. This sump may be formed by the housing itself.

The pump is usually driven by an external motive source such as pulleys or belts connected to an internal combustion engine. The axial pistons of the pump engage a moveable swash plate and, as the pump is rotated by an input source driven by the external engine, the pistons engage the swash plate. Movement of the pump pistons creates movement of the hydraulic fluid from the pump to the motor, causing rotation thereof. The axial pistons of the motor are engaged against a fixed plate, and rotation of the motor drives an output shaft engaged thereto. This output shaft may be linked to mechanical gearing and output axles, which may be internal to the HST housing, as in an IHT, or external thereto. The swash plate is generally controlled by a control arm which is connected via linkage to either a hand control or foot pedal mechanism which the vehicle operator uses to control direction and speed.

The pump system is fully reversible in a standard HST. As the swash plate is moved, the rotational direction of the motor can be changed. The HST closed circuit has two sides, namely a high pressure side in which oil is being pumped from the pump to the motor, and a low pressure or vacuum side, in which oil is being returned from the motor to the pump. When the swash plate angle is reversed, the flow out of the pump reverses so that the high pressure side of the circuit becomes the vacuum side and vice versa. This hydraulic circuit can be formed as porting formed within the HST housing, or internal to a center section on which the pump and motor are rotatably mounted, or in other ways known in the art. Check valves are often used to draw hydraulic fluid into the low pressure side to make up for fluid lost due to leakage, for example.

The hydrostatic pump described herein has a "neutral" position where the pump pistons are not moved in an axial direction, so that rotation of the pump does not create any movement of the hydraulic fluid. Where the pump pistons move vertically, the swash plate is in neutral when it is generally horizontal with respect to the pump pistons. The swash plate need not be horizontal in the neutral position, depending on the orientation of the pump, but it will be generally perpendicular to the pump pistons in the neutral position.

For safety reasons, and for the convenience of the user, it is preferred to have a return to neutral, or zero displacement, feature, which forces the swash plate to its neutral position when no force is being applied to the control arm. Such devices are important for vehicle safety, to eliminate unintended movement of the vehicle, and to return the unit to neutral in the event of an accident where the vehicle operator is unable to physically disengage the transmission. Such return to neutral devices generally involve a spring mechanism engaged to the control arm to force the control arm to a neutral position, which then returns the swash plate to a neutral position. These may be located external to the housing or internally.

One example of a device used to maintain a hydrostatic unit in the zero displacement mode is shown in U.S. Pat. No. 5,207,144. While that design incorporates a spring mechanism to force a return to neutral, the reciprocal follower used to contact the swash plate does not separately pivot itself, leading to binding problems.

SUMMARY OF THE INVENTION

The invention provides an improved return design for a swash plate used with a variable displacement hydraulic pump, and this invention could be adapted for use with any swash plate or equivalent structure in any hydrostatic application. The swash plate has a neutral position wherein the thrust bearing engaging the pump pistons is generally perpendicular to the pistons. This invention uses a separate member such as a plate which directly engages the swash plate. This separate member, or return plate, rotates about an axis with movement of the swash plate; it is also engaged to a preload spring mechanism which acts to force the return plate to a set position that in turn forces the swash plate to a conforming position, which is preferably but not necessarily the neutral position. The preload spring keeps the return plate biased against the housing sockets and the swash plate. The separate return plate can be mounted in a variety of places with respect to the swash plate or can be of different sizes and the location of its axis of rotation simply needs to be altered to reflect such changes.

The present invention not only returns the unit to a set position, but also helps to maintain the unit in this position. Specifically, a stroking force applied to the swash plate through a control arm or similar mechanism causes rotation of the swash plate and the swash plate, in turn, presses on one side of the return plate. The return plate then transmits a restoring force from the spring mechanism to the swash plate, through one contact point. When the stroking force is removed and the swash plate is rotated back to the set position, both contact points are engaged against the swash plate. The force balance between the two contact points keeps the swash plate at the desired set position. The force balance eliminates the dead band found in other return to neutral devices. An optional adjustment feature can be incorporated at the return plate hinge or the swash plate contact points, and can be accessed from outside the housing by means of an external screw. This adjustability eliminates many of the problems heretofore seen with other designs, as the present unit may be adjusted to compensate for design tolerances, wear or contamination, any one of which may otherwise make the actual set position differ from the desired set position.

A second embodiment has the return plate being fitted around the pump cylinder block to provide a more compact design. With such an arrangement, however, the cylinder block prevents mounting the preload spring along the required line of action relative to the return plate. In this embodiment, a second plate, referred to as a preload plate, is used to transmit force from an offset mounted spring to the return plate through two contact points. The correct spring force line of action on the return plate is obtained by the geometry of the preload plate contact points and the spherical pivot of the preload plate. This embodiment enables the use of a more compact design where such may be appropriate.

Further objects and benefits of the invention will be apparent to one skilled in the art.

DETAILED DESCRIPTION OF THE INVENTION

Figure 1:
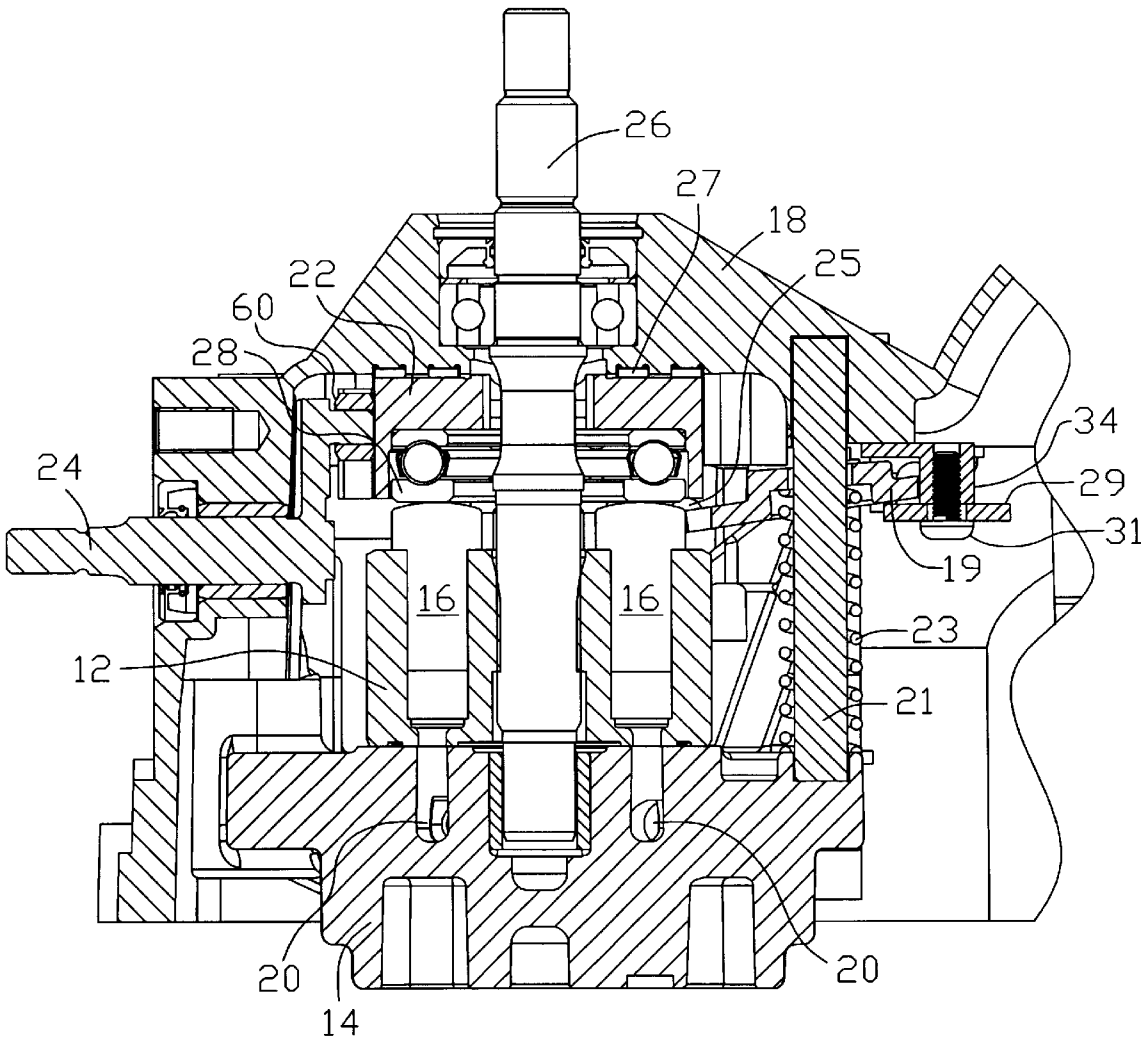
FIG. 1 is a cross-sectional view of a hydraulic pump using a return plate in accordance with the present invention.
Figure 4:
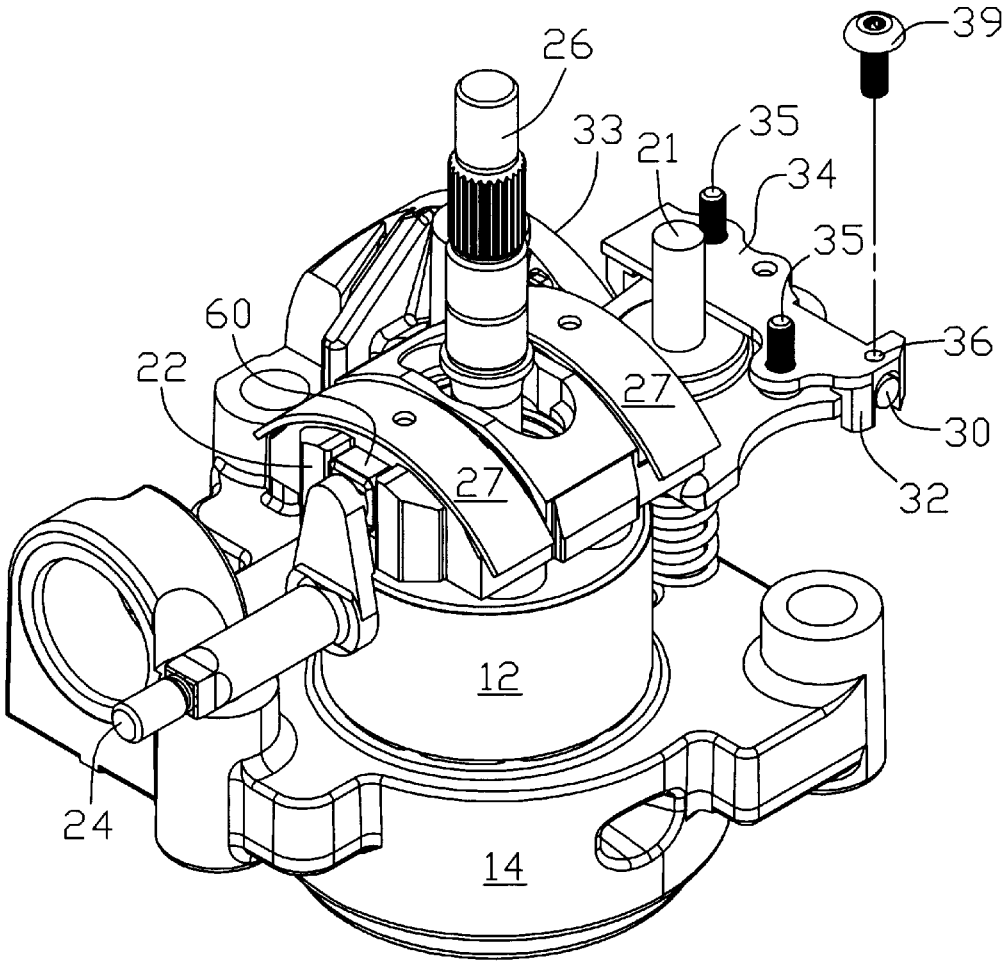
FIG. 4 is a perspective view of a center section, pump and swash plate incorporating this invention, with the unit in the neutral position.
Figure 5:
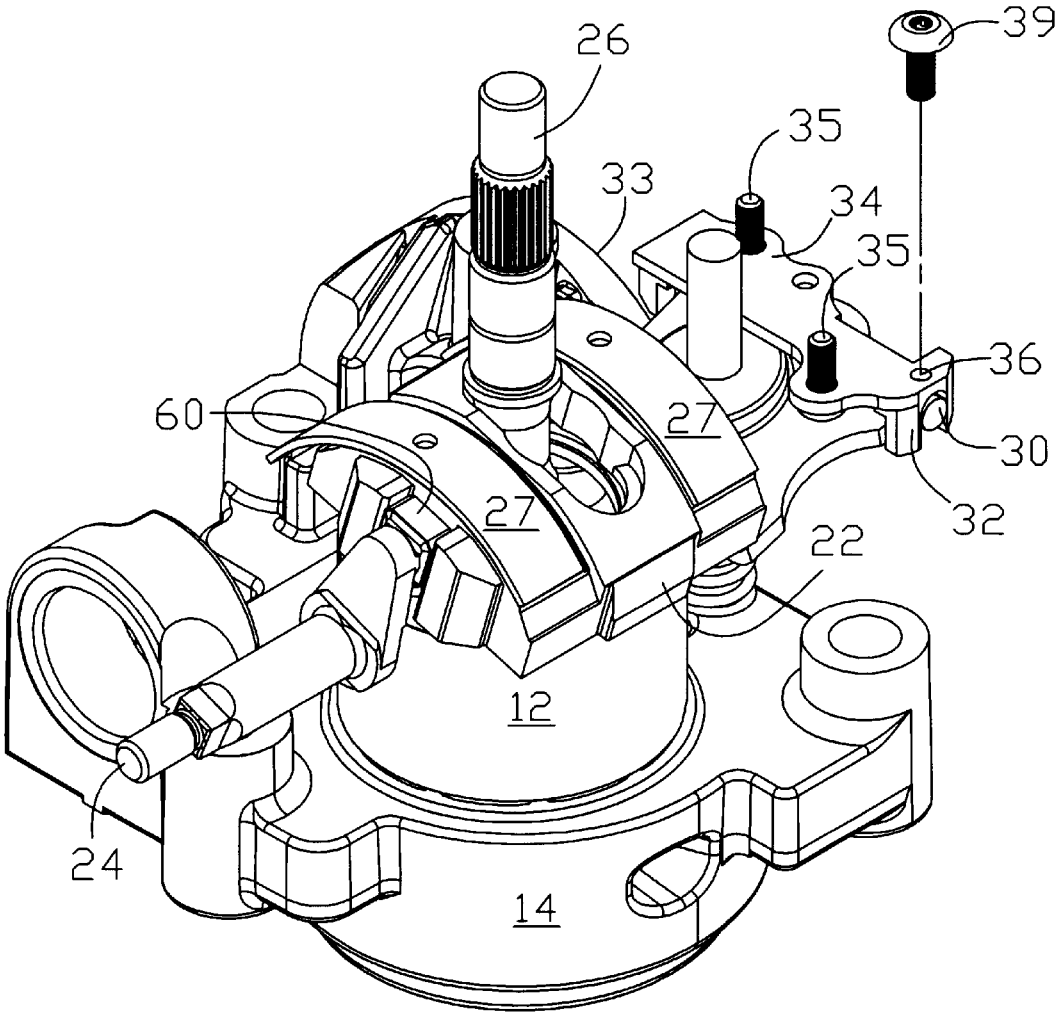
FIG. 5 is a perspective view of the center section, pump and swash plate of the present invention, with the unit in a stroked position.

FIG. 1 shows a cross-sectional view of a standard hydraulic pump as may be used in a hydrostatic application. FIGS. 4 and 5 show certain components of a typical hydrostatic application incorporating the present invention, namely a hydrostatic pump rotatably mounted on a center section. The operation of a hydrostatic application such as a pump, HST or IHT are generally known in the art and will not be described in detail herein. For example, the arrangement of pump 12, center section 14 and the hydrostatic motor are generally described in U.S. Pat. No. 5,314,387, the terms of which are incorporated herein by reference. As noted, this invention could be used in a device having only a pump 12 without the separate hydraulic motor, or with the motor in a separate housing.

Pump cylinder block 12 is rotatably mounted on center section 14, which includes a plurality of hydraulic porting 20 to transfer hydraulic fluid to another component, such as external hoses (not shown) or a hydraulic motor (not shown). A plurality of pump pistons 16 are mounted in cylinder block 12, which is driven by input shaft 26. The motor (not shown) would be mounted on motor running surface 33 of center section 14. The above elements are generally mounted internal to housing 18. Center section 14 and the other components could take on a variety of other shapes and arrangements. By way of example only, the pump and motor cylinder blocks need not be at right angles to one another but could also be in a parallel or back-to-back arrangement, and center section 14 could be formed in the shape of a plate or other structure, or could be formed as part of housing 18. Similarly, for convenience only the upper portion of housing 18 is shown in these figures; the embodiment shown is of a horizontal split line, where upper housing 18 and a corresponding lower housing (not shown) are joined at a split line perpendicular to pump input shaft 26. It will be understood that other housing arrangements and designs could be substituted for this housing shown within the scope of this invention.

Pump pistons 16 are engaged and rotate against swash plate bearing 28. When the unit is in neutral, swash plate bearing 28 is generally perpendicular to input shaft 26. Trunnion arm 24, which may extend out of housing 18, is used to control the direction of swash plate 22, which can rotate about an axis parallel to the plane of the page, as shown in FIG. 1. A slider block 60 may be provided on the side of swash plate 22 and connected to trunnion arm 24 or the like to rotate swash plate 22. Swash plate 22 is mounted on and moves against cradle bearings 27 which engage housing 18.

Figure 3:
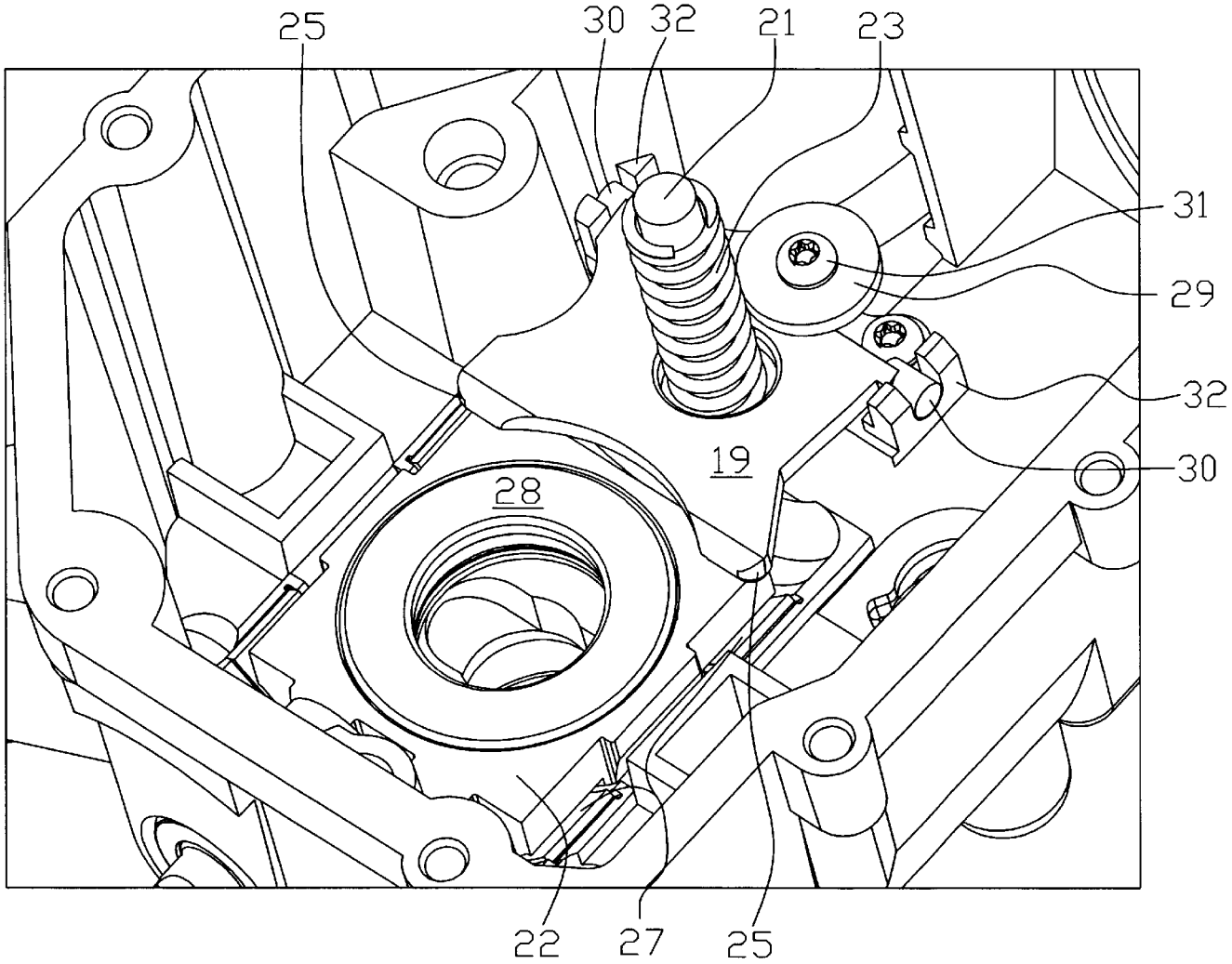
FIG. 3 is perspective view of the swash plate and return plate of FIG. 2, where the hydrostatic unit is in the neutral position.

Return plate 19 is mounted inside housing 18 in contact with swash plate 22. Spring 23 forces return plate 19 against swash plate 22 and pivot housings 32. Return plate 19 includes a pair of projections 25 and a pair of pivot pins 30. The position shown in FIG. 3, where both pins 30 contact pivot housings 32 and projections 25 engage swash plate 22 due to the force of spring 23 on return plate 19, may be referred to as the set position, which is most likely the neutral position. In certain applications the set position may not be set at neutral but could rather be set at a stroked position, depending on the design requirements.

Figure 2:
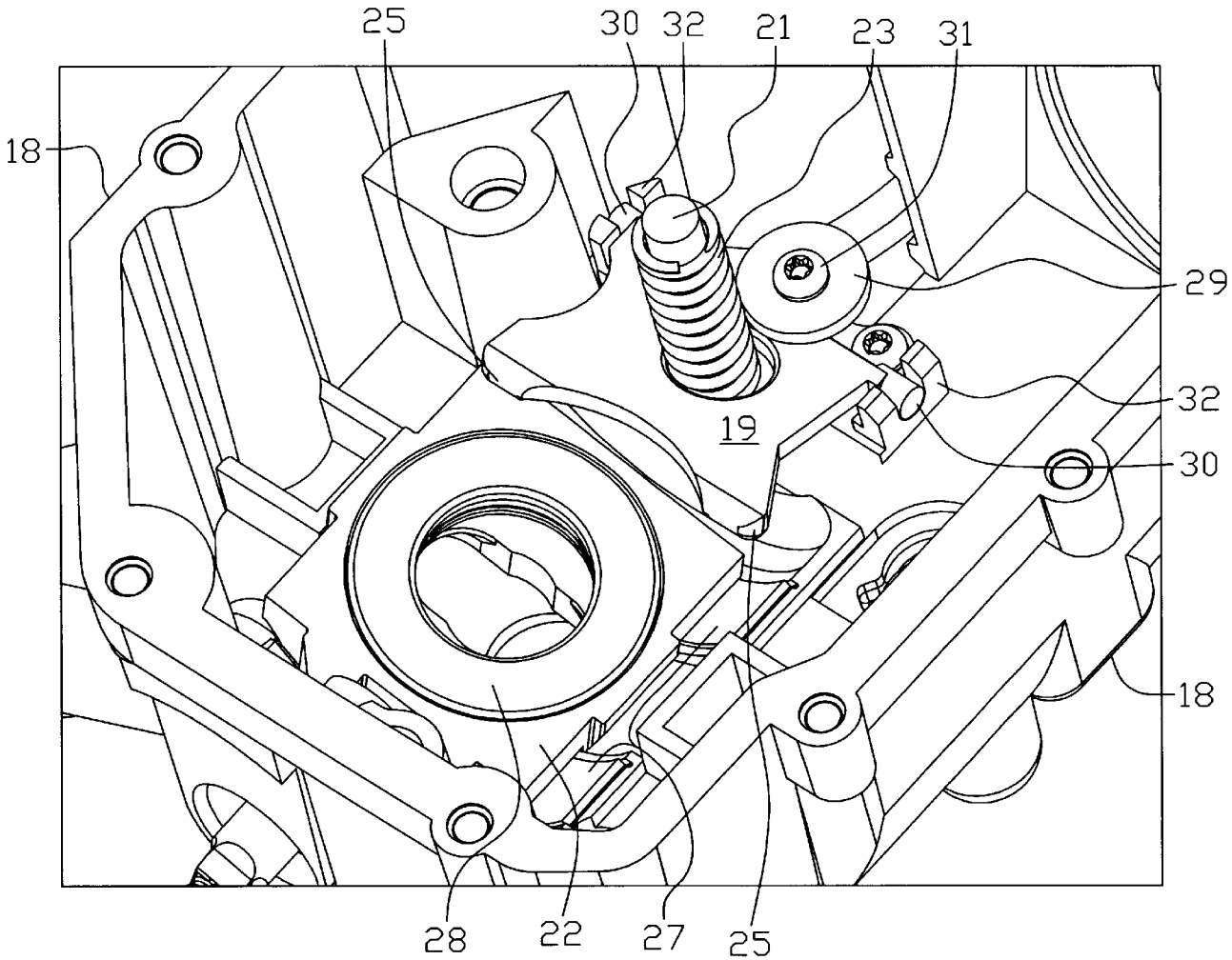
FIG. 2 is a perspective view of a swash plate and single return plate in accordance with this invention, and mounted in a transmission housing, with the unit in a stroked position.
Figure 6:
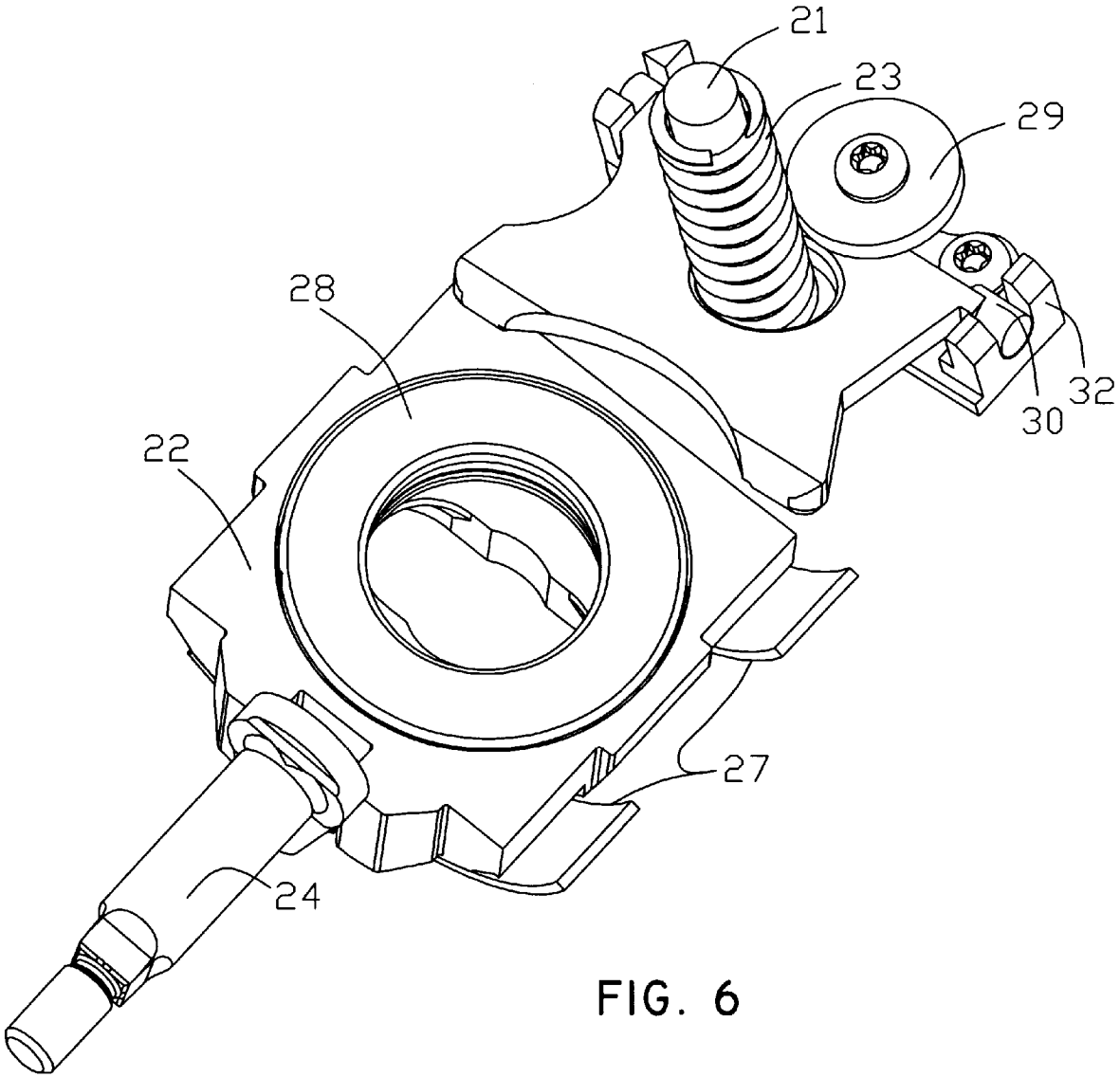
FIG. 6 is a perspective view of a swash plate and a portion of the return to neutral feature of the present invention, where the swash plate is in a stroked position.

When the unit is stroked in one direction, as can be seen most clearly in FIGS. 2 and 6, swash plate 22 will press against one of the projections 25, causing return plate 19 to pivot along the axis perpendicular to the page, as shown in FIG. 1, and thus causing compression of spring 23. The return force of spring 23 acts to counter the rotation of swash plate 22, biasing return plate 19 to the set position, which in turn forces swash plate 22 to the set position.

Pins 30 may be formed as an integral part of return plate 19, or secured to return plate 19 in some other manner. Pins 30 are mounted in pivot housings 32 which may be formed as part of transmission housing 18, or as a separate bracket 34 attached to housing 18 through screws 35, and act as a hinge to allow a separate pivoting of return plate 19. The pivot axis of return plate 19 is different from the pivot axis of swash plate 22, and in the embodiment shown they are perpendicular. The ability of return plate 19 to pivot about such a separate pivot axis (as opposed to, e.g., sliding) reduces the risk of binding of return plate 19 as spring 23 is compressed, as shown in FIG. 6. Other hinge mechanisms could also be used to create the pivot. It is important to note that return plate 19 is not constrained by shaft 21; rather, it is located by pins 30, thus providing the pivoting action for return plate 19. Spring 23 and shaft 21 need not extend through return plate 19; they can be so extended for ease of manufacturing and assembly.

Figure 9:
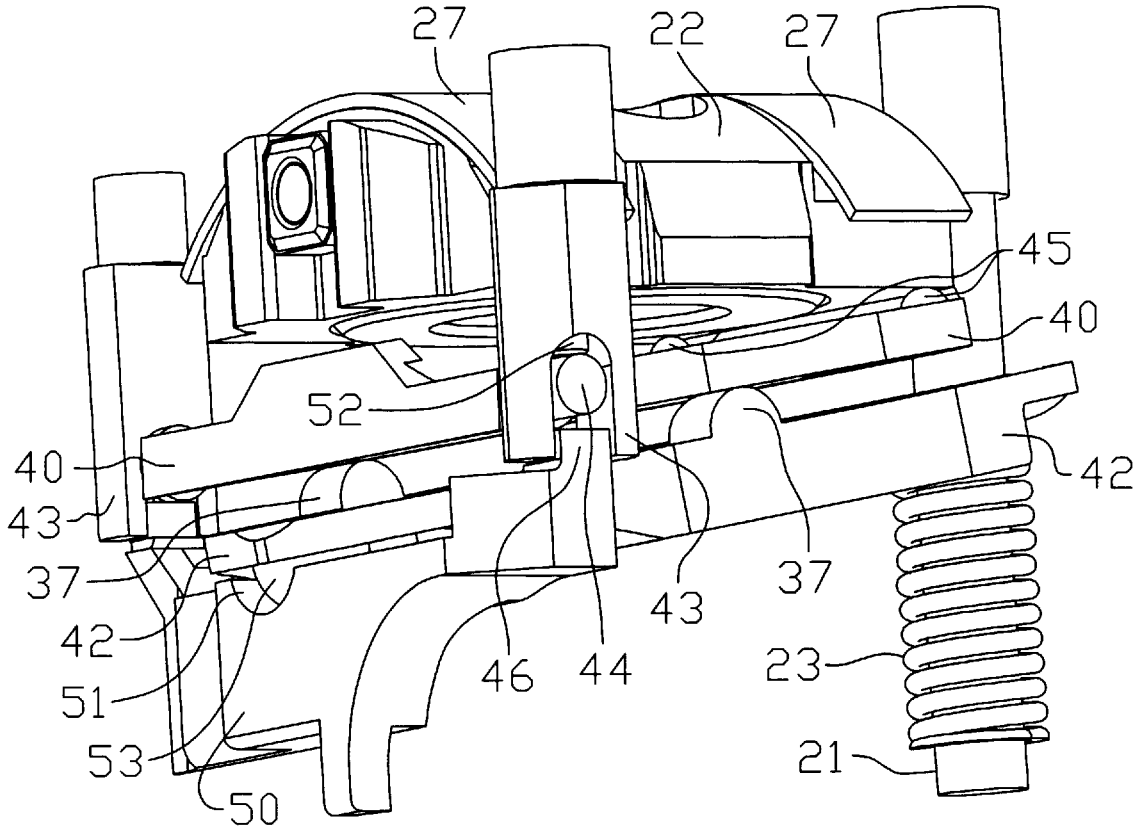
FIG. 9 shows a perspective view of a swash plate and return mechanism of a second embodiment of the invention, where the swash plate is in the neutral position.
Figure 10:
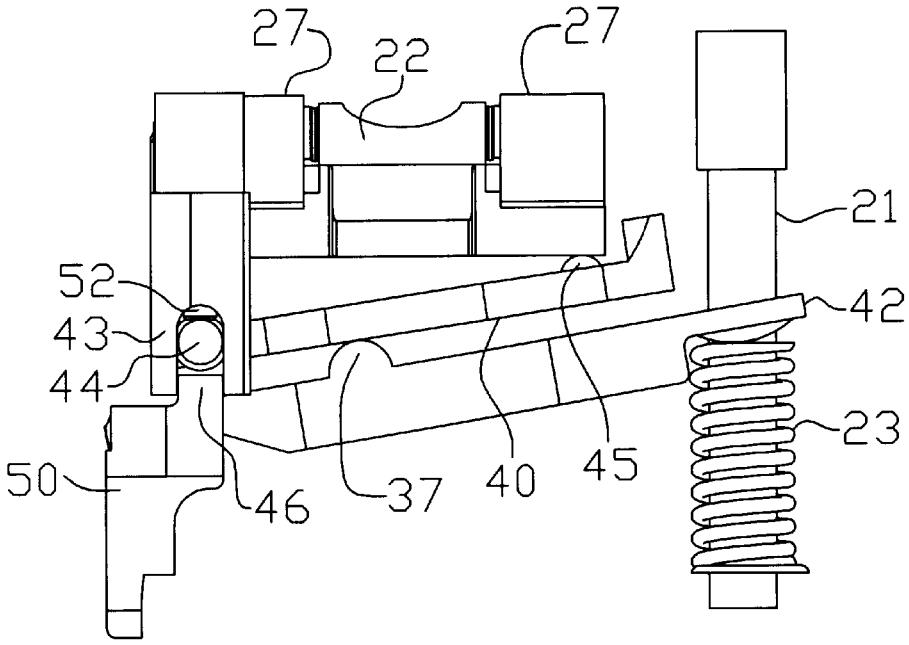
FIG. 10 is a side view of certain components of the second embodiment of this invention, with the swash plate in the neutral position.
Figure 11:
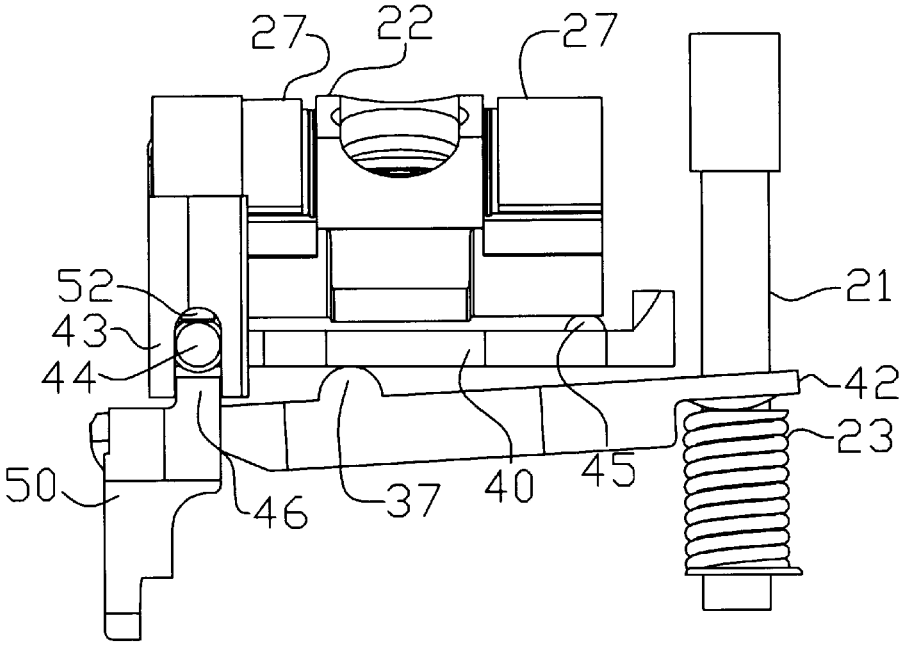
FIG. 11 is a side view of the components shown in FIG. 10 with the swash plate in a stroked position.
Figure 12:
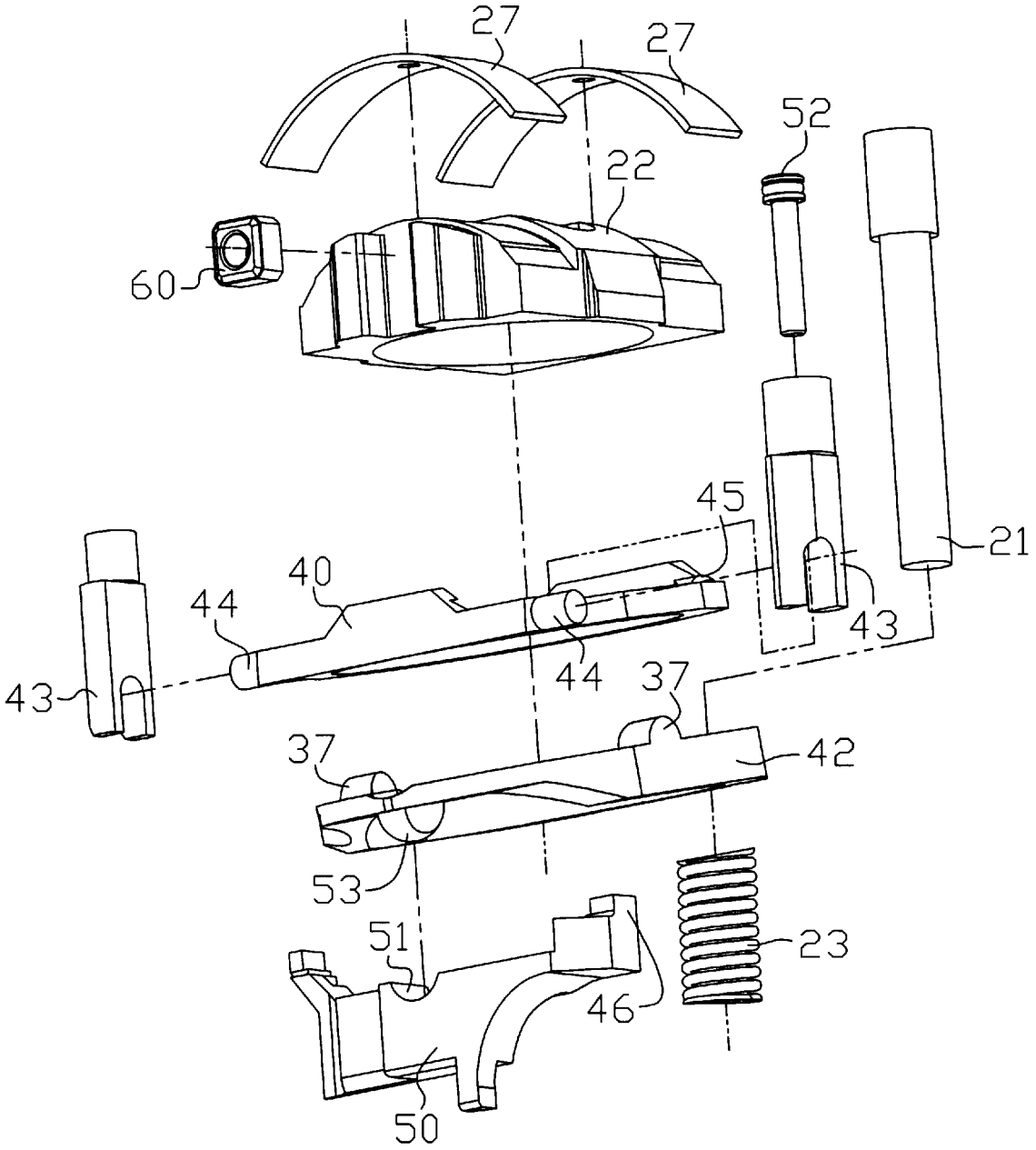
FIG. 12 is an exploded perspective view of the components of the second embodiment of this invention.
Figure 13:
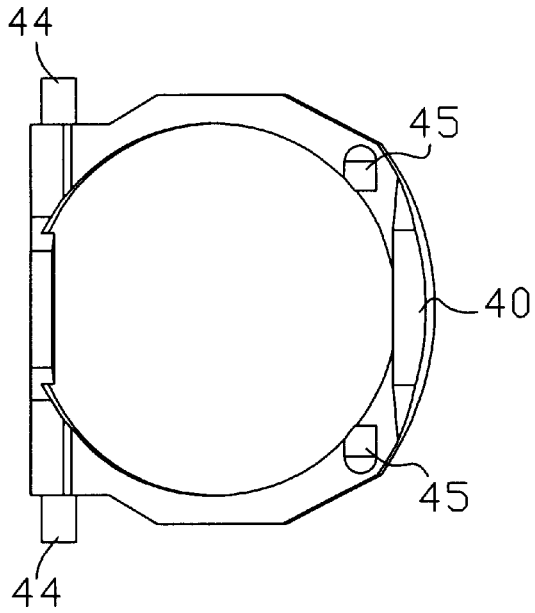
FIG. 13 is a plan view of the return plate of the second embodiment of this invention.
Figure 14:
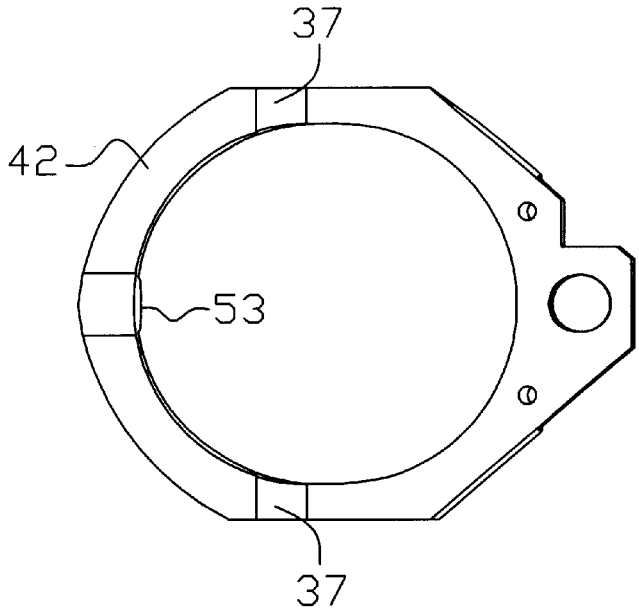
FIG. 14 is a plan view of the preload plate of the second embodiment of this invention.

Washer 29 is an optional safety feature in that it acts as a supplemental means for maintaining return plate 19 in the proper position, e.g., during assembly or if the unit receives an external force. Washer 29 may be secured by a screw 31 or similar device. Other methods of maintaining return plate 19 in place could also be used, such as housing projections or a bracket, as shown in FIGS. 9 and 12.

Spring 23 is shown in this embodiment as being mounted around rod 21, which is supported by housing 18 and center section 14. It is understood that other support mechanisms for spring 23, or even other arrangements of the spring could be used in accordance with this invention. Any device to provide a spring return force to return plate 19 could be used in place of coil spring 23 shown.

The adjustability of the internal return to neutral feature of the present invention is shown in FIGS. 4 and 5. Specifically, adjustment screw 39 extends through hole 36 in bracket 34 to contact pin 30. Rotation of screw 39 in either direction will move return plate 19, allowing the set position of return plate 19 to adjusted as needed. Adjustment screw 39 extends outside of the transmission housing 18, through an opening that should be sealed in some manner to prevent oil leakage. Different adjustment mechanisms could also be used within the spirit of this invention. For example, if pin 30 was a different shape, a wedge device could be inserted between it and the bracket, and movement of the wedge in or out would provide the adjustment.

A second embodiment of this invention is shown in FIGS. 7–14, where identical element numbers denote common elements. This embodiment allows for a different arrangement of elements to accommodate smaller housing designs or the use of additional equipment which may require certain space within the housing.

In this embodiment, return plate 40 is shaped to fit around cylinder block 12 with pivot pins 44 and projections 45 on opposite sides of cylinder block 12. However, this arrangement precludes the desired location of the return spring element between pivot pins 44 and projections 45. Thus, the second embodiment uses a preload plate 42 which is directly engaged to the spring 23 and which engages return plate 40 at projections 37. As swash plate 22 is moved out of the set position, it will exert a force upon one or the other of the projections 45, causing a rotation of return plate 40 about its pivot point, which in this embodiment is about an axis between pins 44. In this embodiment, pins 44 are formed as a part of return plate 40 and are mounted in pivot housings 43. Pivot housings 43 are shown as being formed separately from main housing 18, although they could also be formed integrally therewith. The optional safety function similar to that served by washer 19 of the first embodiment is served by projections 46 which are shown as being formed as integral to support bracket 50. Bracket 50 is shown as a separate element secured within housing 18; it may also be formed integrally as a portion of the housing or center section 14. Preload plate 42 has a spherical or multi-axis pivot 53 that mates with slot 51 formed on bracket 50. Pivot 53 allows preload plate 42 to contact return plate 40 at projections 37 with generally equal forces as return plate 40 is moved by swash plate 22 and by changes to adjustment screw 52. The function of pivot 53 may also be accomplished by other support arrangements that would enable the motions of pivot 53 as disclosed. Slot 51 allows pivot 53 and thus preload plate 42 to move generally perpendicular to pin 21 to prevent binding of preload plate 42. Slot 51 could be replaced by a socket in bracket 50 to receive pivot 53 and a longer slot in preload plate 42 to provide for clearance for pin 21.

Figure 7:
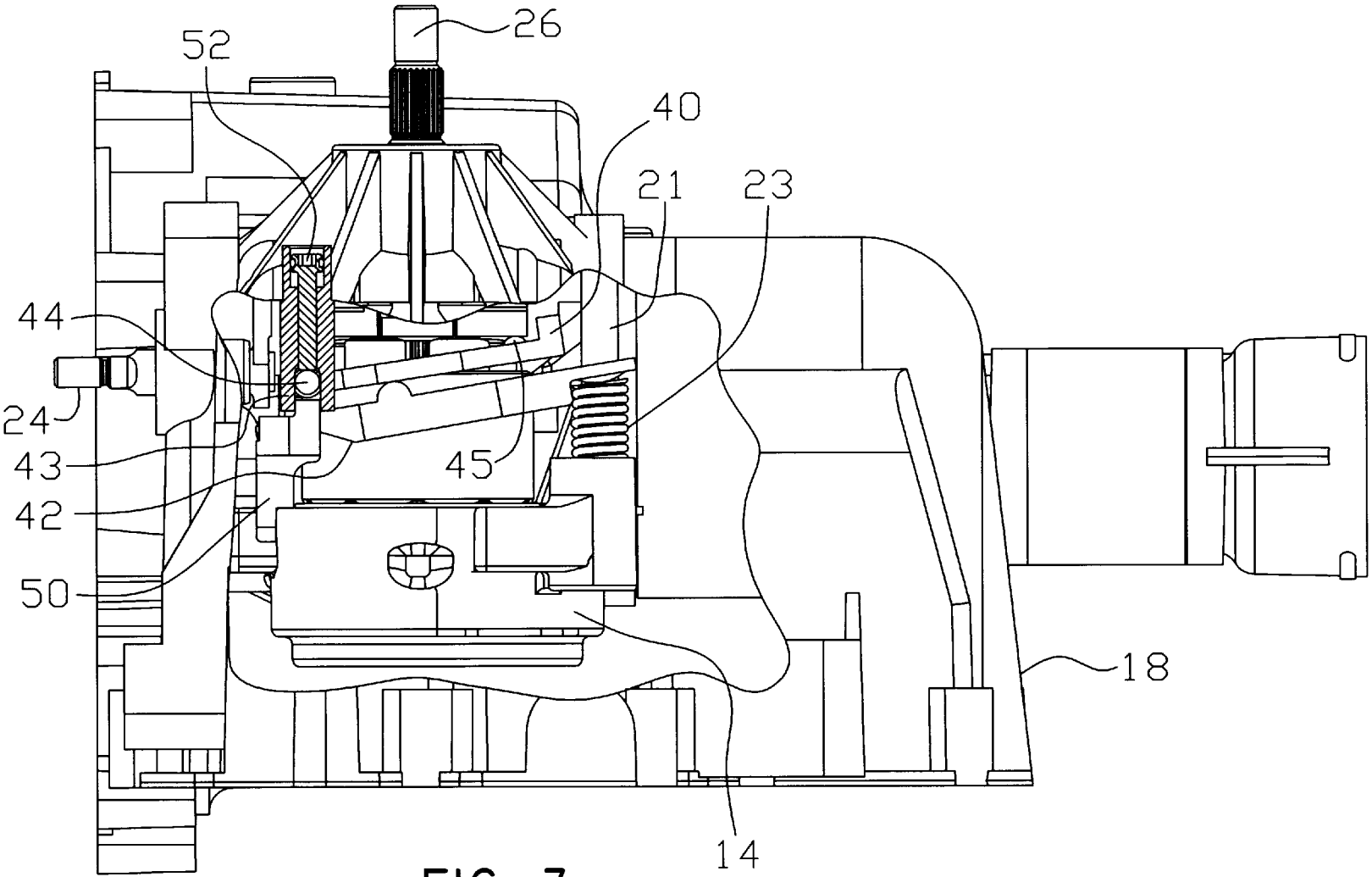
FIG. 7 is a partial cross-sectional view of a second embodiment of this invention, with certain elements removed for clarity.
Figure 8:
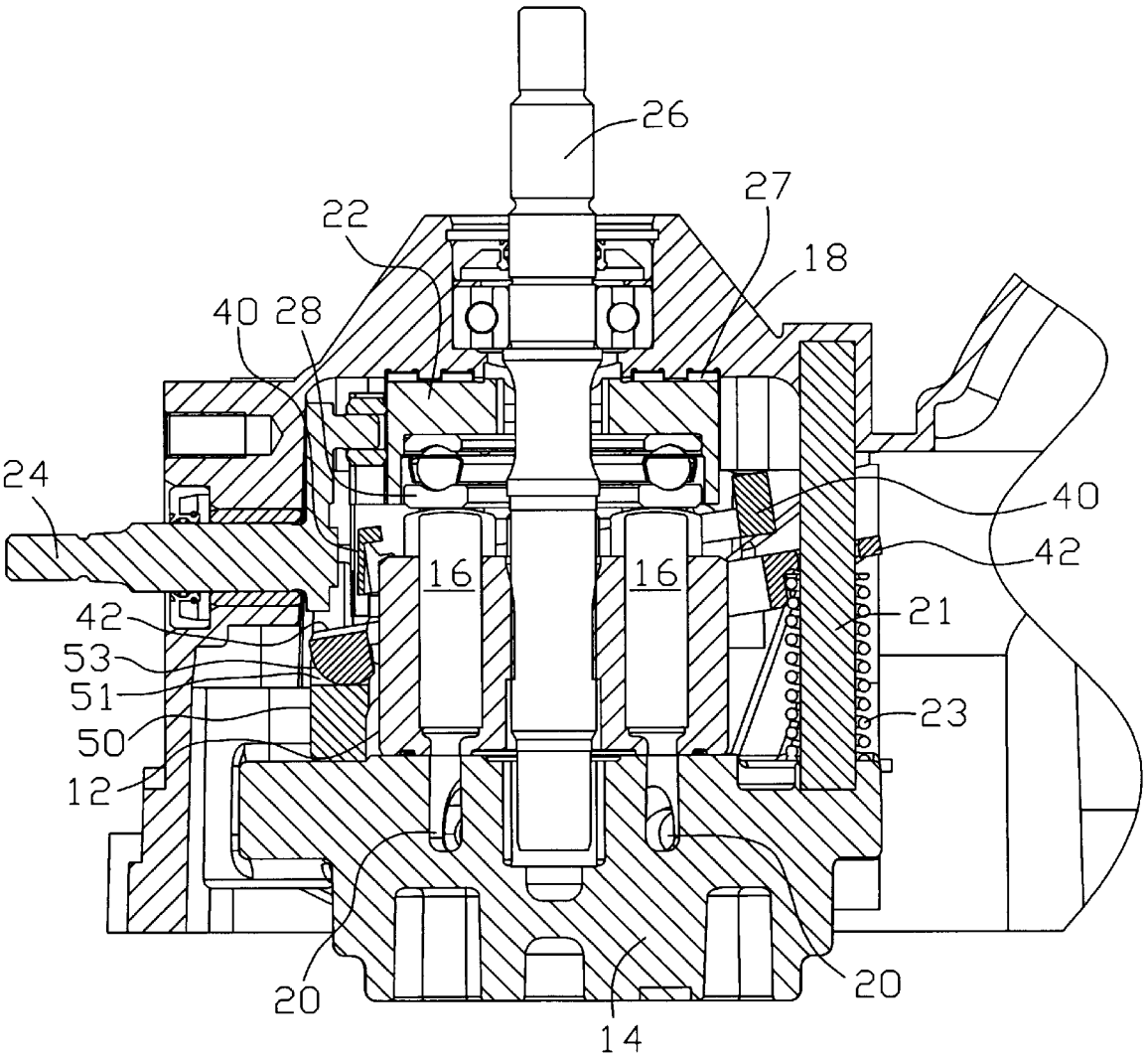
FIG. 8 shows a cross-sectional view of a second embodiment of this invention.

As shown most clearly in FIGS. 7 and 9, adjustment screw 52 extends through pivot housing 43 and can extend out of the transmission housing 18 to permit adjustment. It may be sealed through an o-ring at the head thereof or some other known method.

Preload plate 42 is engaged to spring 23, which could be any type of spring return mechanism. Preload plate 42 also includes a series of projections 37 to engage return plate 40 and bias it to the set position, which would force swash plate 22 to the set position. The location of projections 37 on preload plate 42 closer to pins 44 than to spring 23 acts to prevent pins 44 from lifting out of pivot housings 43 when the unit is in stroke. One could modify the radius of projections 37 or use a series of projections 37 on preload plate 42 in conjunction with modifying the location of the pivot point of preload plate 42 with respect to the pivot point of return plate 40 to change the return force as the unit moves away from the set position. As an example, a reduced return force in stroke could make it easier for an operator to maintain the unit in stroke compared to a similar unit without such a modification, while achieving the appropriate amount of return force as the unit nears the set position.

Figure 15:
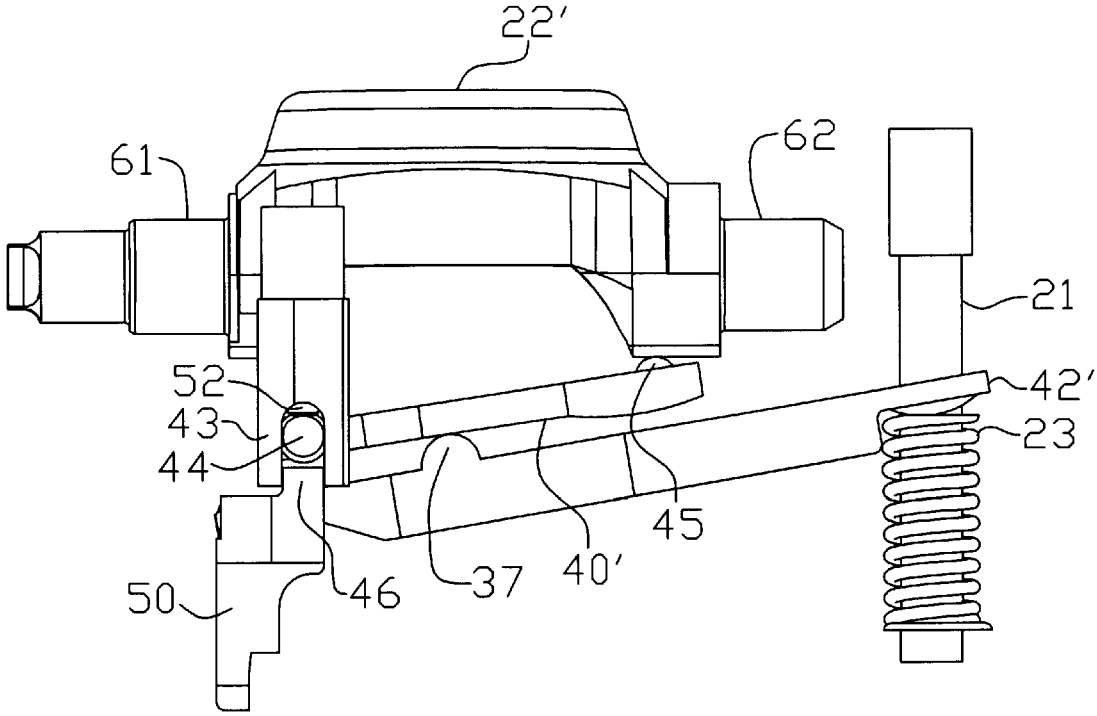
FIG. 15 is a side view of a third embodiment of the invention.

The various embodiments shown in FIGS. 1–14 depict a cradle-mounted swash bearing, but other designs could be used. For example, FIG. 15 shows a trunnion mounted swash plate 22' having a first trunnion 61 which would extend out of the device housing to be attached to a control device or the like (not shown) and a second trunnion 62 which would be rotatably mounted in a opening in the housing or some similar structure. Return plate 40' would be shaped to accommodate the shape of swash plate 22'. Other elements could be substantially identical to the embodiment shown in FIGS. 7–14. It will be understood by one of skill in the art that trunnion mounted swash plate 22' could also be used with the embodiment shown in FIGS. 1–6.

It is to be understood that the above description of the invention should not be used to limit the invention, as other embodiments and uses of the various features of this invention will be obvious to one skilled in the art. This invention should be read as limited by the scope of its claims only.

What is claimed is:

1. A hydrostatic device mounted in a housing, said device comprising:

a rotatable pump including a plurality of pistons;

a swash plate engaged to said pump pistons and pivotable about a first axis, said swash plate having a neutral position and a plurality of stroked positions;

a pivot housing located in said hydrostatic device housing;

a return plate engaging said swash plate and having a set position;

a plurality of pins secured to said return plate and engaged to said pivot housing so that said return plate is rotatable from said set position about a second axis that is different from said first axis;

a spring mechanism engaged to said return plate to force said return plate to return to said set position; and an adjustment mechanism to adjust the set position of said return plate.

2. A hydrostatic device as set forth in claim 1, wherein said spring mechanism comprises a shaft mounted in said housing and a coil spring mounted around said shaft.

3. A hydrostatic device as set forth in claim 1, wherein said adjustment mechanism comprises a screw that contacts said return plate.

4. A hydrostatic device as set forth in claim 3, wherein said screw is accessible from outside said housing.

5. A hydrostatic device as set forth in claim 1, wherein said set position of said return plate corresponds to said neutral position of said swash plate.

6. A hydrostatic device as set forth in claim 1, wherein said swash plate is a cradle mounted swash plate.

7. A hydrostatic device as set forth in claim 1, wherein said swash plate is a trunnion mounted swash plate.

8. A hydrostatic device as set forth in claim 1, further comprising a center section on which said rotatable pump is mounted, and a hydraulic motor mounted on said center section, wherein said center section comprises hydraulic porting formed therein to connect said pump to said motor.

9. A hydrostatic device as set forth in claim 8, wherein said pump is mounted at a right angle to said motor.

10. A hydrostatic device as set forth in claim 9, wherein said swash plate is a cradle-mounted swash plate.

11. A hydrostatic device mounted in a housing and comprising a rotatable pump for transferring hydraulic fluid and having a plurality of pump pistons;

an input shaft engaged to said pump;

a movable swash plate engaged to said pump pistons for modifying the quantity of hydraulic fluid transferred by said pump, said swash plate being pivotable about a first axis;

a return plate having a first side engaged to said swash plate by at least two contact points, said return plate having a set position; and a hinge engaged to said return plate so that said return plate is pivotable at a second side thereof about a second axis that is different from said first axis, wherein said hinge comprises a plurality of pins mounted in pivot housings.

12. A hydrostatic device as set forth in claim 11, wherein said pins are integrally formed with said return plate.

13. A hydrostatic device mounted in a housing, said device comprising a rotatable pump for transferring hydraulic fluid and having a plurality of pump pistons;

an input shaft engaged to said pump;

a movable swash plate engaged to said pump pistons for modifying the quantity of hydraulic fluid transferred by said pump, said swash plate being pivotable about a first axis;

a return plate having a first side engaged to said swash plate by at least two contact points, said return plate being pivotable at a second side thereof about a second axis that is perpendicular to said first axis, said return plate having a set position.

14. A hydrostatic device as set forth in claim 13, further comprising a spring mechanism engaged to said return plate to force said return plate to return to said set position.

15. A hydrostatic device as set forth in claim 14, wherein said spring mechanism comprises a shaft secured to said housing and a coil spring mounted around said shaft and engaging said return plate, wherein said set position corresponds to the neutral position of said swash plate.

16. A hydrostatic device as set forth in claim 13, further comprising an adjustment mechanism to adjust the set position of said return plate.

17. A hydrostatic device as set forth in claim 16, wherein said adjustment mechanism comprises a screw that contacts said return plate, wherein said set position corresponds to the neutral position of said swash plate.

18. A hydrostatic device as set forth in claim 17, wherein said screw is accessible from outside said housing.

19. A hydrostatic device as set forth in claim 13, wherein said set position corresponds to the neutral position of said swash plate.

20. A hydrostatic device as set forth in claim 13, wherein said swash plate comprises a cradle mounted swash plate.

21. A hydrostatic device as set forth in claim 13, wherein said swash plate comprises a trunnion mounted swash plate.

22. A hydrostatic device as set forth in claim 13, further comprising a rotatable motor and a center section mounted in said housing, wherein said rotatable pump and said rotatable motor are mounted on said center section and said center section comprises hydraulic porting formed therein to connect said rotatable pump to said rotatable motor.

23. A hydrostatic device as set forth in claim 22, wherein said motor is mounted at a generally right angle to said input shaft.

24. A hydrostatic transmission having a rotatable pump and rotatable motor mounted in a housing, said pump having a plurality of pump pistons, wherein said transmission comprises:

an input shaft engaged to said rotatable pump;

a movable swash plate engaged to said pump pistons and pivotable about a first axis, said swash plate having a neutral position and a plurality of stroked positions;

a first plate having an opening formed therein and mounted around said pump cylinder block, said first plate having a first side and a second side, said first side contacting said swash plate by at least two contact points, said set plate having a set position;

a second plate engaged to said first plate on the second side thereof; and a spring mechanism engaged to said second plate to force said first plate to return to said set position.

25. A hydrostatic device as set forth in claim 24, wherein said set position of said first plate corresponds to said neutral position of said swash plate.

26. A hydrostatic device as set forth in claim 25, wherein said first plate is rotatable about a second axis that is different from said first axis.

27. A hydrostatic device as set forth in claim 26, wherein said second axis is perpendicular to said first axis.

28. A hydrostatic device as set forth in claim 24, further comprising an adjustment mechanism for adjusting the location of said first plate, wherein said adjustment mechanism comprises a screw that contacts said first plate.

29. A hydrostatic device as set forth in claim 24, wherein said spring mechanism comprises a shaft secured to said device housing and a coil spring mounted around said shaft.

30. A hydrostatic transmission having a rotatable pump and rotatable motor mounted in a housing, said pump having a plurality of pump pistons, wherein said transmission comprises:

a movable swash plate engaged to said pump pistons for modifying the quantity of hydraulic fluid transferred by said pump, said swash plate being pivotable about a first axis;

a return plate having a first side engaged to said swash plate by at least two contact points, said return plate being pivotable at a second side thereof about a second axis that is perpendicular to said first axis, said return plate having a set position corresponding to the neutral position of said swash plate.

31. A hydrostatic transmission as set forth in claim 30, further comprising a spring mechanism engaged to said return plate to force said return plate to return to said set position.

32. A hydrostatic transmission as set forth in claim 31, wherein said spring mechanism comprises a shaft secured to said housing and a coil spring mounted around said shaft.

33. A hydrostatic transmission as set forth in claim 32, further comprising a supplemental means for retaining said return plate in said housing.

34. A hydrostatic transmission as set forth in claim 33, wherein said supplemental means comprises a washer.

35. A hydrostatic transmission as set forth in claim 30, further comprising a means for adjusting the set position of said return plate.

36. A hydrostatic transmission as set forth in claim 31, further comprising an adjustment mechanism to adjust the set position of said return plate.

37. A hydrostatic transmission as set forth in claim 36, wherein said adjustment mechanism comprises a screw that contacts said return plate.

38. A hydrostatic transmission as set forth in claim 30, further comprising a center section on which said rotatable pump and rotatable motor are mounted, wherein said center section comprises hydraulic porting formed therein to connect said pump to said motor.

39. A hydrostatic device as set forth in claim 38, wherein said swash plate comprises a trunnion mounted swash plate.

40. A hydrostatic device as set forth in claim 30, wherein said swash plate comprises a cradle mounted swash plate.

41. A hydrostatic device mounted in a housing, said device comprising:

a rotatable pump for transferring hydraulic fluid and having a plurality of pump pistons;

an input shaft engaged to said pump;

a movable swash plate engaged to said pump pistons for modifying the quantity of hydraulic fluid transferred by said pump, said swash plate being pivotable about a first axis;

a return plate having a first side engaged to said swash plate by at least two contact points, said return plate being pivotable at a second side thereof about a second axis that is different from said first axis, said return plate having a set position; and a washer adjacent to said return plate.

42. A hydrostatic transmission having a rotatable pump and rotatable motor mounted in a housing, said pump having a plurality of pump pistons, wherein said transmission comprises:

a movable swash plate engaged to said pump pistons for modifying the quantity of hydraulic fluid transferred by said pump, said swash plate being pivotable about a first axis;

a return plate having a first side engaged to said swash plate by at least two contact points, said return plate being pivotable at a second side thereof about a second axis that is different from said first axis, said return plate having a set position corresponding to the neutral position of said swash plate; and a plurality of pins secured to said return plate to permit said return plate to rotate about said second axis.

43. A hydrostatic device as set forth in claim 42, wherein said pins are integrally formed with said return plate.

44. A hydrostatic device mounted in a housing, said device comprising:

a rotatable pump including a cylinder block and a plurality of pistons mounted in said cylinder block;

a movable swash plate engaged to said pump pistons and pivotable about a first axis, said swash plate having a neutral position and a plurality of stroked positions;

a first plate having an opening formed therein and mounted around said pump cylinder block, said first plate having a first side and a second side, said first side contacting said swash plate by at least two contact points, said first plate having a set position;

a second plate engaged to said first plate on the second side thereof; and a spring mechanism engaged to said second plate.

45. A hydrostatic device as set forth in claim 44, wherein said first plate is rotatable from said set position about a second axis that is different from said first axis.

46. A hydrostatic device as set forth in claim 45, wherein said second axis is perpendicular to said first axis.

47. A hydrostatic device as set forth in claim 44, further comprising an adjustment mechanism for adjusting the location of said first plate.

48. A hydrostatic device as set forth in claim 47, wherein said adjustment mechanism comprises a screw that contacts said first plate.

49. A hydrostatic device as set forth in claim 44, wherein said spring mechanism comprises a shaft secured to said device housing and a coil spring mounted around said shaft.

50. A hydrostatic device as set forth in claim 44, further comprising a means for adjusting the set position of said first plate.

51. A hydrostatic device as set forth in claim 44, further comprising a plurality of pins secured to said first plate to permit said first plate to rotate about said second axis.

52. A hydrostatic device as set forth in claim 51, further comprising a plurality of pivot housings in which said pins are mounted.

53. A hydrostatic device as set forth in claim 52, wherein said pivot housings are formed as part of said device housing.

54. A hydrostatic device as set forth in claim 52, further comprising a bracket to limit movement of said pins in a direction perpendicular to said second axis of rotation.

55. A hydrostatic device as set forth in claim 54, wherein said bracket is formed as part of said device housing.

56. A hydrostatic device as set forth in claim 44, further comprising a center section on which said rotatable pump is mounted.

57. A hydrostatic device as set forth in claim 56, further comprising a hydraulic motor mounted on said center section, wherein said center section comprises hydraulic porting formed therein to connect said pump to said motor.

58. A hydrostatic device as set forth in claim 57, wherein said pump is mounted generally perpendicular to said motor.

59. A hydrostatic device as set forth in claim 56, further comprising a plurality of pivot housings in which said pins are mounted, wherein said pivot housings are formed its part of said center section.

60. A hydrostatic device as set forth in claim 44, wherein said swash plate is a trunnion mounted swash plate.

61. A hydrostatic device as set forth in claim 44, wherein said swash plate is a cradle mounted swash plate.

62. A hydrostatic device mounted in a housing, comprising:

a rotatable pump including a plurality of pistons;

a swash plate engaged to said pump pistons and pivotable about a first axis, said swash plate having a neutral position and a plurality of stroked positions;

a return plate engaging said swash plate and having a set position, said return plate being rotatable from said set position about a second axis that is perpendicular to said first axis;

a spring mechanism engaged to said return plate to force said return plate to return to said set position; and an adjustment mechanism to adjust the set position of said return plate.

* * * * *